US009630793B2

(12) United States Patent
Kozaki

(10) Patent No.: US 9,630,793 B2
(45) Date of Patent: Apr. 25, 2017

(54) SHEET CONVEYING DEVICE

(71) Applicant: BROTHER KOGYO KABUSHIKI KAISHA, Nagoya-shi, Aichi-ken (JP)

(72) Inventor: Daisuke Kozaki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/695,573

(22) Filed: Apr. 24, 2015

(65) Prior Publication Data

US 2015/0307299 A1 Oct. 29, 2015

(30) Foreign Application Priority Data

Apr. 25, 2014 (JP) ..... 2014-091418

(51) Int. Cl.

| | |
|---|---|
| ***B65H 3/34*** | (2006.01) |
| ***B65H 3/66*** | (2006.01) |
| ***B65H 5/36*** | (2006.01) |
| ***B65H 3/56*** | (2006.01) |
| ***B65H 5/38*** | (2006.01) |

(52) U.S. Cl.

CPC ..... *B65H 5/36* (2013.01); *B65H 3/34* (2013.01); *B65H 3/56* (2013.01); *B65H 3/66* (2013.01); *B65H 5/38* (2013.01); *B65H 2402/44* (2013.01); *B65H 2405/324* (2013.01); *B65H 2601/24* (2013.01); *B65H 2801/39* (2013.01)

(58) Field of Classification Search

CPC ..... B65H 5/38; B65H 3/0684; B65H 3/56; B65H 5/36; B65H 3/66; B65H 3/34; H04N 1/00525; H04N 1/0053; H04N 1/00535

See application file for complete search history.

(56) References Cited

U.S. PATENT DOCUMENTS

| | | | | |
|---|---|---|---|---|
| 8,210,520 | B2 * | 7/2012 | Su | B65H 3/0684 271/109 |
| 8,469,351 | B2 * | 6/2013 | Kozaki | B65H 1/04 271/3.14 |
| 8,608,152 | B2 * | 12/2013 | Takahata | G03G 15/602 271/213 |
| 2007/0194520 | A1 * | 8/2007 | Kusama | B65H 5/062 271/225 |
| 2010/0109226 | A1 * | 5/2010 | Kitazawa | B65H 5/24 271/3.14 |
| 2011/0285078 | A1 * | 11/2011 | Andoh | B65H 7/04 271/265.01 |
| 2012/0155941 | A1 | 6/2012 | Kozaki et al. | |
| 2014/0131937 | A1 * | 5/2014 | Tsai | B65H 3/0684 271/10.11 |

FOREIGN PATENT DOCUMENTS

JP 2012-126530 A 7/2012

* cited by examiner

*Primary Examiner* — Luis A Gonzalez
(74) *Attorney, Agent, or Firm* — Merchant & Gould P.C.

(57) ABSTRACT

A sheet conveying device includes: a conveyor configured to convey a sheet; a cover configured to cover the conveyor; a guide spaced apart from the cover; and a movable member mounted on a first member which is one of the cover and the guide. The movable member is pivotable between a first position and a second position and located at the second position when the sheet is being conveyed. The movable member has a free end which is moved toward a second member while the movable member is being pivoted from the second position to the first position about a pivot center. The second member is another of the cover and the guide. The free end is contactable with the second member by an approach of the cover toward the guide when the movable member is located at the first position.

17 Claims, 10 Drawing Sheets

SHEET CONVEYING DEVICE

CROSS REFERENCE TO RELATED APPLICATION

The present application claims priority from Japanese Patent Application No. 2014-091418, which was filed on Apr. 25, 2014, the disclosure of which is herein incorporated by reference in its entirety.

BACKGROUND

Technical Field

The following disclosure relates to a sheet conveying device.

Description of the Related Art

There is known an image reading apparatus which is provided with an automatic document feeder (ADF) including: a conveying unit for conveying a document; and a cover with which the conveying unit is covered.

There is known an ADF in which a conveying unit is covered with a cover, and a guide is disposed under the cover so as to form a space therebetween which serves as a conveyance path.

A document is conveyed by the conveying unit along a conveyance path formed under the guide and then conveyed onto an upper surface of the guide while making U-turn along the conveyance path. The document is then conveyed along the conveyance path formed between the guide and the cover and discharged onto an upper surface of the image reading apparatus.

SUMMARY

In the above-described image reading apparatus, the conveyance path is formed just under the cover. Thus, a lower portion of the cover is not supported in an area where the cover and the conveyance path overlap each other when viewed from an upper side thereof. For example, the space serving as the conveyance path is formed just under a central portion (when viewed from an upper side) of the cover, but no support is provided on a lower portion of the central portion. Also, for example, the cover has four side edges, and an opening is formed just under one of the four side edges, which opening serves as an entrance and an exit for the document conveyed by the conveying unit. This opening makes it impossible to provide a support for supporting the lower portion of the cover at an area near this opening.

In case where a load is applied to the cover from an upper side thereof, however, the cover is easily deformed at its portions not supported from below, which may distort an outer surface of the cover. In particular, in the case where the cover is made relatively thin to make the entire ADF thinner, flexural rigidity of the cover is easily deteriorated, leading to an increase in possibility of the above-described distortion. Such distortion gives a user an impression that the construction of the cover is not strong.

In the case where a load is applied to the cover only temporarily, even if the cover is elastically deformed by some amount, the shape of the cover is returned to its original shape once the load disappears. However, in the case where an excessively large load is kept applied to the cover for a long time (for example, a heavy object is placed on the cover for a long time), the cover may suffer from creep strain. In the case where such creep strain is caused, the shape of the cover is not easily returned to its original shape once the load disappears, so that the conveyance path just under the cover is made narrower. Such narrower conveyance path increases a possibility of occurrence of a document jam.

Accordingly, an aspect of the disclosure relates to a sheet conveying device including a cover disposed over a conveyance path and not easily causing distortion of the cover even in the case where a load is applied to the cover.

In one aspect of the disclosure, a sheet conveying device includes: a conveyor configured to convey a sheet along a conveyance path in a conveying direction; a cover configured to cover the conveyor; a guide spaced apart from the cover, the conveyance path formed therebetween; and a movable member mounted on a first member which is one of the cover and the guide. The movable member is pivotable between a first position and a second position. The movable member is located at the second position when the conveyor is conveying the sheet along the conveyance path. The movable member includes a free end configured to be moved toward a second member while the movable member is being pivoted from the second position to the first position about a pivot center. The second member is another of the cover and the guide. The free end of the movable member is contactable with the second member by an approach of the cover toward the guide when the movable member is located at the first position.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Hereinafter, there will be described a sheet conveying device according to one embodiment.

Configuration of MFP

Figure 1:
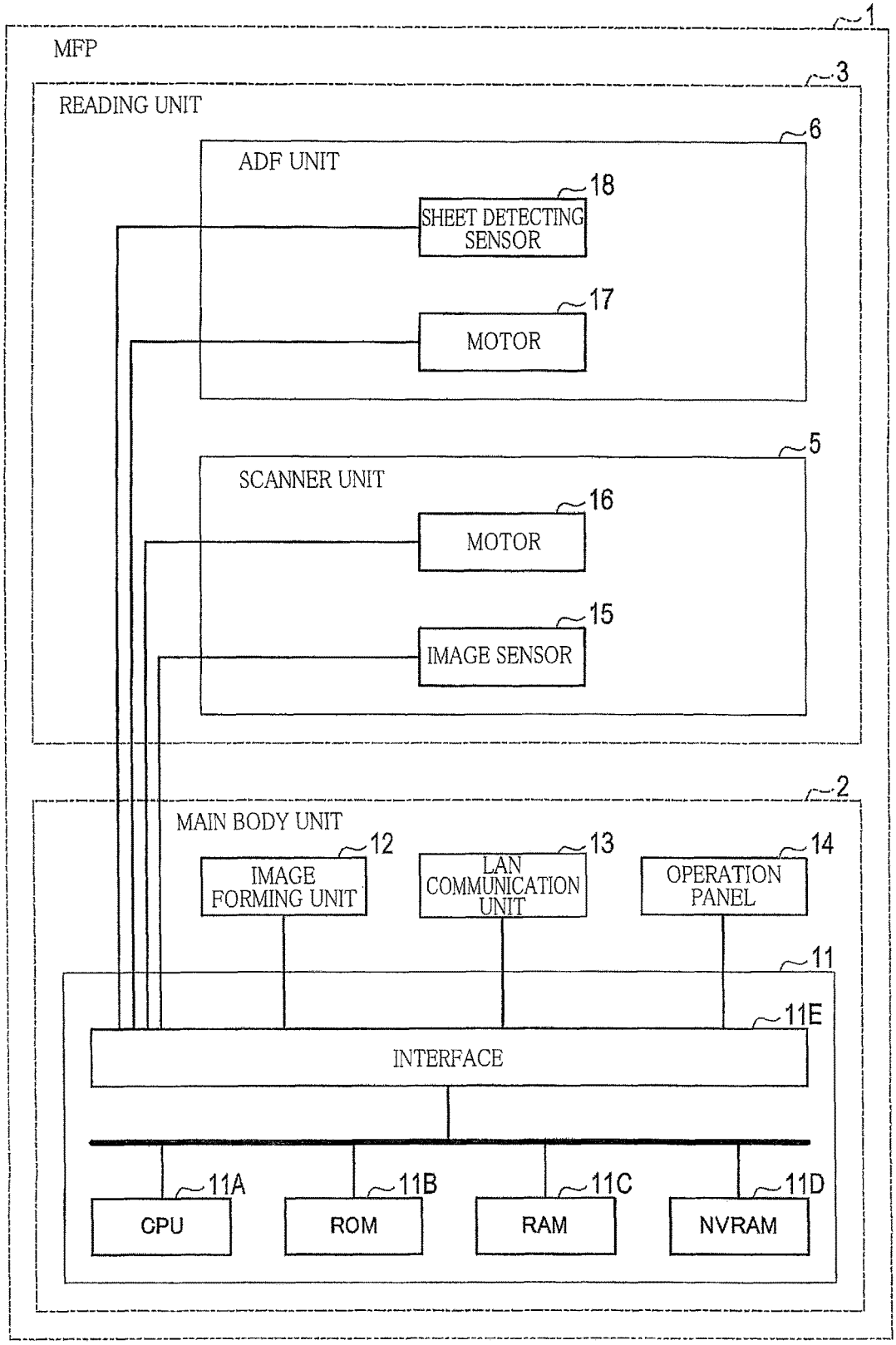
FIG. 1 is a block diagram illustrating a configuration of a multi-function peripheral (MFP)

A multi-function peripheral (MFP) 1 illustrated in FIG. 1 has a configuration corresponding to one example of the sheet conveying device. For easy understanding of a relative positional relationship of components of the MFP 1, in the following explanation, there will be expressed (a) an upward and downward direction which is a direction perpendicular to a horizontal plane in the case where the MFP 1 is placed on the horizontal plane, (b) a front direction in which an operation panel 14 which will be described below faces, (c) a rear direction which is opposite the front direction, and (d) a right and left direction which is a right and left direction in the case where the MFP 1 is viewed from a front side thereof. A direction of a movable component may be changed, and the directions illustrated in figures (FIGS. 2-9) are not always kept.

As illustrated in FIG. 1, the MFP 1 includes a main body unit 2 and a reading unit 3. An upper face of the main body unit 2 has an opening, not shown. The reading unit 3 is mounted in an upper portion of the main body unit 2 and movable between a closed position and an open position. When the reading unit 3 is located at the closed position, the opening of the main body unit 2 is closed by the reading unit 3. When the reading unit 3 is located at the open position, the opening of the main body unit 2 is open or exposed. Through this opening, a user can perform maintenance of components provided in the main body unit 2. The reading unit 3 includes a scanner unit 5 and an ADF unit 6 as one example of a sheet conveying device. Constructions of the scanner unit 5 and the ADF unit 6 will be described below.

As illustrated in FIG. 1, the main body unit 2 includes a controller 11. The controller 11 includes well-known devices such as a CPU 11A, a ROM 11B, a RAM 11C, an NVRAM 11D, and an interface 11E. The CPU 11A controls the components and devices of the MFP 1 by executing processings according to control programs stored in the ROM 11B and the RAM 11C.

The components and devices controlled by the controller 11 include an image forming unit 12, a LAN communication unit 13, the operation panel 14, an image sensor 15, a motor 16, a motor 17, and a sheet detecting sensor 18. The image forming unit 12, the LAN communication unit 13, and the operation panel 14 are provided in the main body unit 2. The image sensor 15 and the motor 16 are provided in the scanner unit 5. The motor 17 and the sheet detecting sensor 18 are provided in the ADF unit 6.

The image forming unit 12 is an ink jet image forming unit capable of forming an image on a recording medium such as a cut sheet. Specifically, the image forming unit 12 includes: a conveying mechanism for conveying the recording medium; a recording head for ejecting ink; and a drive mechanism for reciprocating the recording head. These devices are well known, and an explanation and illustration of which are dispensed with. It is noted that the image forming unit 12 may be an electronic-photographic image forming unit.

The LAN communication unit 13 includes a communication interface device for wireless LAN and a communication interface device for wired LAN. The operation panel 14 includes input devices and output devices. The input devices are operated by the user for providing various instructions to the MFP 1. Examples of the input devices include a touch panel and various kinds of buttons and switches. The output devices are for notifying the user about an operating state of the MFP 1. Examples of the output devices include a liquid crystal display and various kinds of lamps.

The image sensor 15 is a one-dimensional image sensor including a plurality of reading elements arranged in one direction. In the present embodiment, the image sensor 15 is a contact image sensor (CIS). The motor 16 is a power source for moving the image sensor 15 in a sub-scanning direction which is perpendicular to a main scanning direction coinciding with the direction in which the reading elements of the image sensor 15 are arranged. The motor 17 is a power source for conveying the sheet by the ADF unit 6. The sheet detecting sensor 18 detects that a leading edge or a trailing edge of the sheet conveyed by the ADF unit 6 in a sheet conveying direction has passed through a predetermined detecting position.

In the present embodiment, the sheet detecting sensor 18 is a contact sensor whose ON state and OFF state are switched depending on whether the sheet being conveyed is contacting the sensor or not. However, another type of sensor may be used as the sheet detecting sensor 18. For example, the sheet detecting sensor 18 may be a non-contact sensor capable of detecting that the leading edge or the trailing edge of the sheet in the sheet conveying direction has passed through the predetermined detecting position. Examples of such a non-contact sensor include: an optical sensor capable of detecting whether the sheet being conveyed is intercepting a light path or not; and an optical sensor capable of detecting whether light is reflected from the sheet being conveyed or not.

Details of Reading Unit

Figure 2A:
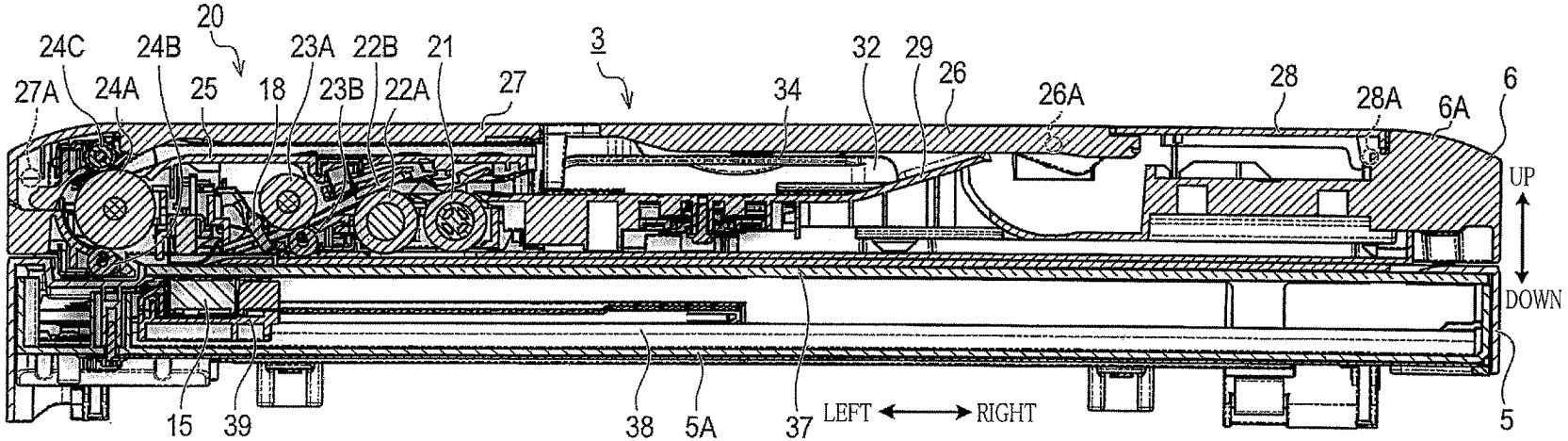
FIG. 2A is an elevational view in vertical cross section illustrating a reading unit whose central cover is located at a closed position.
Figure 2B:
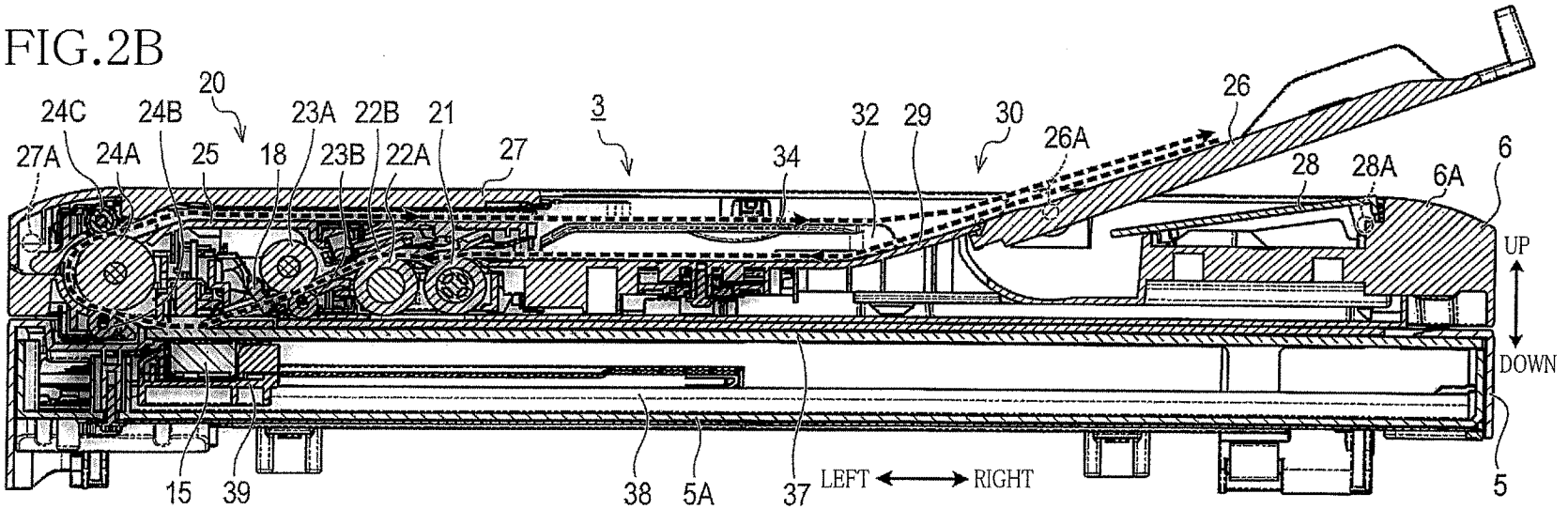
FIG. 2B is an elevational view in vertical cross section illustrating the reading unit whose central cover is located at an open position.

There will be next explained the configuration of the reading unit 3 in more detail. As illustrated in FIGS. 2A and 2B, the ADF unit 6 of the reading unit 3 includes a conveying unit 20 (as one example of a conveyor) configured to convey a sheet along a predetermined conveyance path indicated by the broken line in FIG. 2B. This conveying unit 20 includes a supply roller 21, a separation roller 22A, a separation piece 22B, a relay roller 23A, a relay pinch roller 23B, an inverting roller 24A, a first inverting pinch roller 24B, and a second inverting pinch roller 24C. A guide 25 (as one example of a first member) extending along the conveyance path is provided over the supply roller 21, the separation roller 22A, the separation piece 22B, the relay roller 23A, and the relay pinch roller 23B so as to cover these components from an upper side thereof.

The ADF unit 6 includes an ADF base 6A, a central cover 26, a left cover 27 (as one example of a cover and a second member), and a right cover 28. The ADF base 6A stores the conveying unit 20. The central cover 26, the left cover 27, and the right cover 28 are respectively supported by support shaft portions 26A, 27A, 28A so as to be pivotable with respect to the ADF base 6A. A support shaft and a bearing constituting the support shaft portion 26A are configured such that one of the support shaft and the bearing is provided on the central cover 26, and the other is provided on a component such as the ADF base 6A as the base portion of the ADF unit 6 (e.g., the ADF base 6A or a component fixed to the ADF base 6A). Likewise, a support shaft and a bearing constituting the support shaft portion 27A are configured such that one of the support shaft and the bearing is provided on the left cover 27, and the other is provided on, e.g., the ADF base 6A. A support shaft and a bearing constituting the support shaft portion 28A are configured such that one of the support shaft and the bearing is provided on the right cover 28, and the other is provided on, e.g., the ADF base 6A. The central cover 26, the left cover 27, and the right cover 28 constitute an upper exterior of the MFP 1 in a state in which the central cover 26, the left cover 27, and the right cover 28 are located at their respective positions illustrated in FIG. 2A.

In the state illustrated in FIG. 2A, a main tray 29 formed integrally with the ADF base 6A is provided under the central cover 26. When the central cover 26 is pivoted or moved from its closed position illustrated in FIG. 2A to its open position illustrated in FIG. 2B, the central cover 26 and the main tray 29 are positioned so as to be adjacent to and flush with each other (at boundary portion of the central cover 26 and the main tray 29). In this open position, the central cover 26 serves as a sub-tray, and the central cover 26 and the main tray 29 constitute a supporter 30 which supports a sheet or sheets not having been conveyed by the conveying unit 20 yet.

When the central cover 26 is pivoted from the closed position illustrated in FIG. 2A to the open position illustrated in FIG. 2B, the right cover 28 is moved or displaced from a horizontal position illustrated in FIG. 2A to an inclined position illustrated in FIG. 2B in conjunction with the pivotal movement of the central cover 26. Specifically, the center of gravity of the right cover 28 is nearer to the central cover 26 than to the support shaft portion 28A, that is, the center of gravity is located at the left of the center of the right cover 28 in FIG. 2A. Thus, an end portion of the right cover 28 near the central cover 26 (i.e., a left end portion thereof in FIG. 2A) is always urged downward by the weight of the right cover 28. However, in the state in which the right cover 28 is located at the horizontal position illustrated in FIG. 2A, the end portion of the right cover 28 near the central cover 26 (i.e., the left end portion thereof in FIG. 2A) is superposed on an end portion of the central cover 26 (i.e., a right end portion thereof in FIG. 2A). With this construction, the central cover 26 prevents downward movement of the end portion of the right cover 28 near the central cover 26 (i.e., the left end portion thereof in FIG. 2A). Accordingly, the right cover 28 is kept at the horizontal position as long as the central cover 26 is located at the closed position.

When the central cover 26 is moved from the closed position to the open position by a user operation, on the other hand, the right cover 28 is pivoted by its own weight following the central cover 26 and moved to the inclined position illustrated in FIG. 2B while kept in contact with the central cover 26. It is noted that when the right cover 28 reaches the inclined position, the central cover 26 is located at the open position and spaced apart from the right cover 28. When the right cover 28 is located at the inclined position, the right cover 28 is inclined downward at the end portion thereof near the central cover 26 (i.e., the left end portion thereof in FIG. 2B). This construction prevents the central cover 26 and the right cover 28 from interfering with each other when the central cover 26 is moved to the open position. When the central cover 26 is moved from the open position to the closed position, the central cover 26 is brought into contact with the right cover 28 at an intermediate position. During movement of the central cover 26 to the closed position thereafter, the central cover 26 is moved while kept in contact with the right cover 28, and the right cover 28 is moved to the horizontal position by a force received from the central cover 26.

When located at the closed position illustrated in FIG. 2A, the left cover 27 covers the conveying unit 20 and the guide 25. In this state, a space serving as the conveyance path is formed between the guide 25 and the left cover 27. When the left cover 27 is pivoted to its open position, not shown, the conveying unit 20 and the guide 25 are exposed. With this construction, in case where a sheet is jammed in the conveying unit 20, the user can pivot the left cover 27 to the open position to remove the jammed sheet.

Figure 3A:
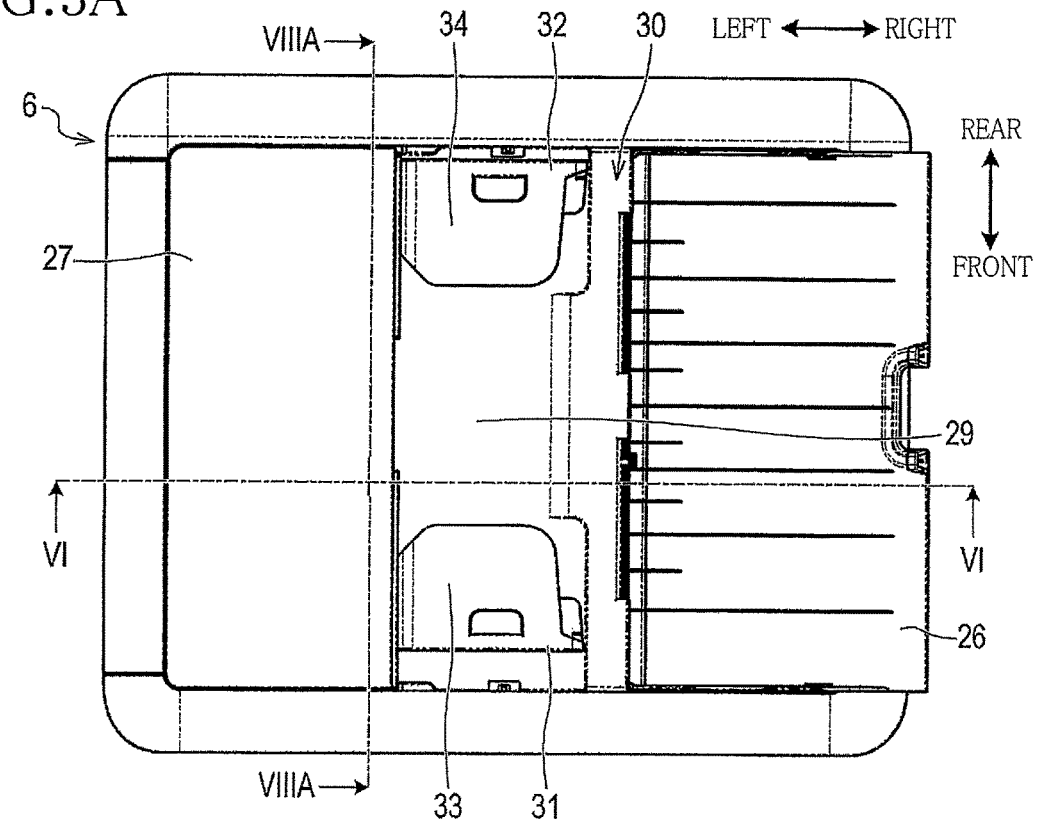
FIG. 3A is a plan view illustrating an ADF unit in a state in which the central cover is located at the open position.

As illustrated in FIG. 3A, side guides 31, 32 are provided on the main tray 29. The side guides 31, 32 are slid in a widthwise direction of the sheet (i.e., the front and rear direction in FIG. 3A) to change a distance therebetween in the widthwise direction. When one of the side guides 31, 32 is slid by the user in one direction, the other guide is slid in a direction opposite the one direction in conjunction with the sliding movement of the one guide. With this construction, the side guides 31, 32 can be slid toward or away from each other.

The side guides 31, 32 are respectively provided with extending portions 33, 34 extending generally horizontally toward each other from upper edges of the respective side guides 31, 32. When placed on the supporter 30, a sheet or sheets to be conveyed to the conveying unit 20 are set under these extending portions 33, 34. The side guides 31, 32 are respectively brought into contact with opposite edges of the placed sheets in its widthwise direction to correct a position of the sheets on the main tray 29 and a sheet conveying direction of the sheet. This operation can reduce a possibility of occurrence of skew of the sheet conveyed by the conveying unit 20.

Each of the sheets placed on the supporter 30 is conveyed along the conveyance path indicated by the broken line in FIG. 2B. In this conveyance, the sheets are supplied by the supply roller 21 from the main tray 29 toward a downstream side thereof in the conveying direction and separated one by one by the separation roller 22A and the separation piece 22B. The separated sheet is conveyed by the relay roller 23A toward a downstream side thereof in the sheet conveying direction. The sheet conveyed by the relay roller 23A is brought into contact with the sheet detecting sensor 18, so that a leading edge and/or a trailing edge of the sheet is detected. The sheet having passed through the sheet detecting sensor 18 is conveyed by the inverting roller 24A to an area located between the guide 25 and the left cover 27 and then discharged from the conveying unit 20. When discharged, the sheet is conveyed onto the extending portions 33, 34. In the case of a sheet of a relatively large size, a portion of the sheet reaches the supporter 30 constituted by the main tray 29 and the central cover 26. That is, in the present embodiment, the supporter 30 also serves as a construction for supporting the sheet discharged from the conveying unit 20.

As illustrated in FIGS. 2A and 2B, the scanner unit 5 includes a platen 37, a guide rail 38, and a carriage 39. The platen 37 is a transparent glass plate which constitutes a support surface as an upper surface of the scanner unit 5 which supports an object to be read. The guide rail 38 is integrally formed in an inner surface of a bottom portion of a scanner base 5A as a base portion of the scanner unit 5. The guide rail 38 extends in the right and left direction in FIG. 2B in a state in which the guide rail 38 is parallel with a lower surface of the platen 37. The carriage 39 is mounted on an upper surface of the guide rail 38. In this state, the carriage 39 is supported so as to be reciprocable along the guide rail 38 in the right and left direction. This carriage 39 is coupled to an endless toothed belt, not shown. When the toothed belt is driven and rotated by the motor 16 (see FIG. 1), the carriage 39 is reciprocated in the right and left direction following the toothed belt.

The image sensor 15 is mounted on the carriage 39 in a state in which the main scanning direction coincides with the front and rear direction in FIG. 2A (i.e., a direction perpendicular to each of the right and left direction and the up and down direction in FIG. 2A), and the reading elements face upward. With this construction, when the carriage 39 is reciprocated in the right and left direction, the image sensor 15 is moved with the carriage 39 in the sub-scanning direction. In the case where the image sensor 15 reads an image on a sheet placed on the upper surface of the platen 37, the image sensor 15 reads the image while moving together with the carriage 39. In the case where the image sensor 15 reads an image of a sheet conveyed by the conveying unit 20, the sheet passes through the upper surface of the platen 37 while contacting the upper surface, at a position located between the relay roller 23A and the inverting roller 24A. The movement of the image sensor 15 is stopped under this contact position, and the image sensor 15 reads the image on the sheet through the platen 37.

Mechanism for Suppressing Deformation of Left Cover

Figure 3B:
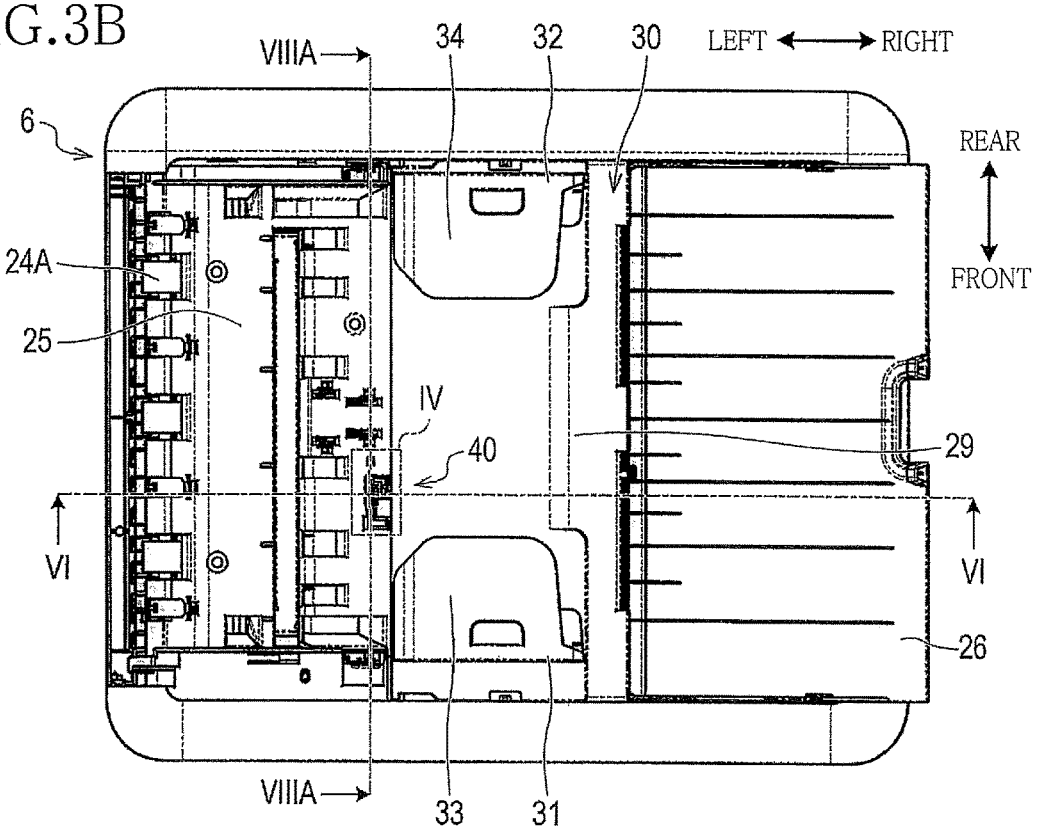
FIG. 3B is a plan view illustrating a state in which a left cover is removed from the ADF unit illustrated in FIG. 3A.
Figure 4:
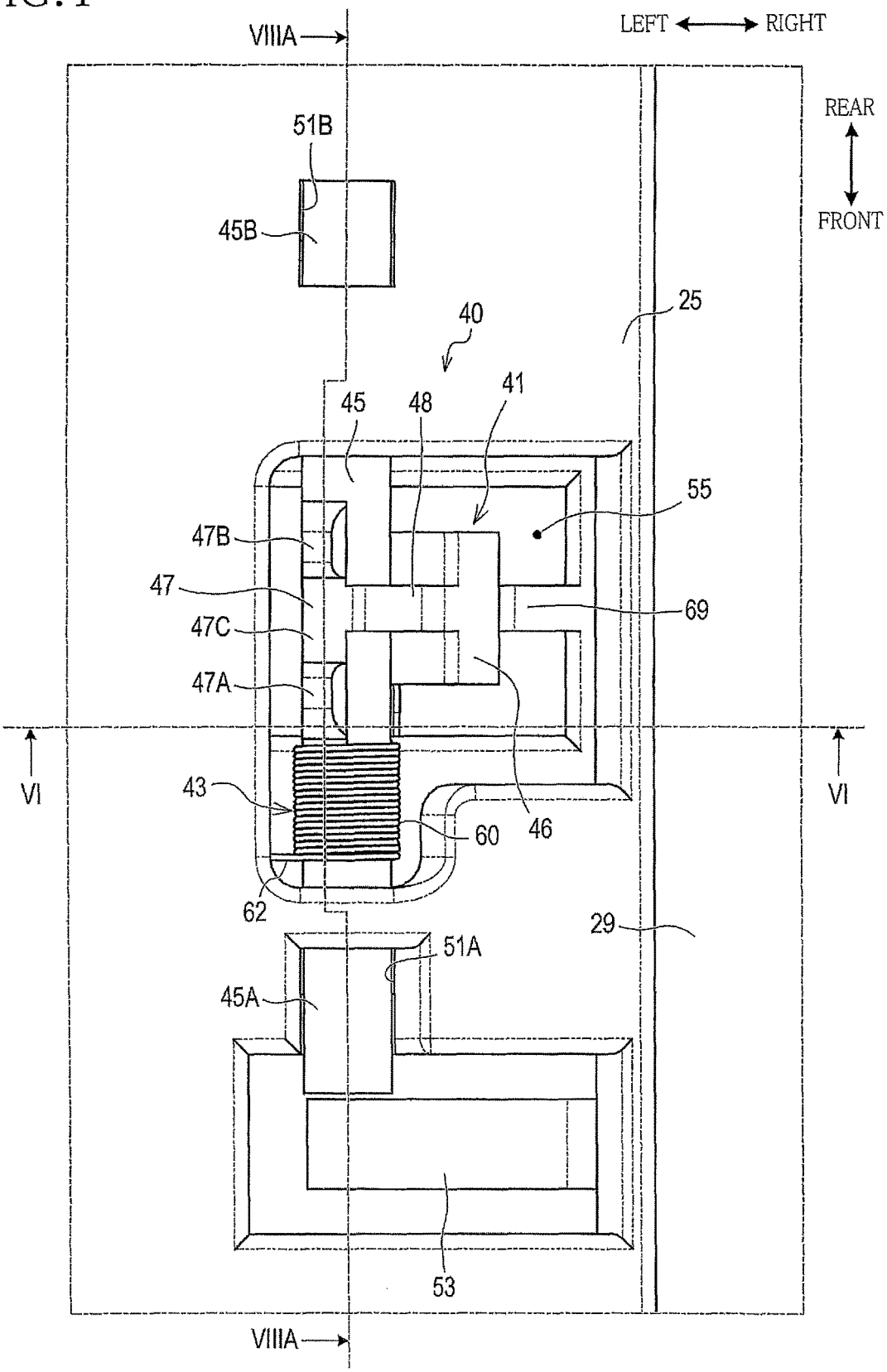
FIG. 4 is an enlarged view of an area IV in FIG. 3B.

There will be next explained a mechanism for suppressing deformation of the left cover 27. As illustrated in FIGS. 3B and 4, the guide 25 is provided with a deformation suppressing portion 40 for suppressing deformation of the left cover 27. It is noted that each of the line VI-VI and the line VIIIA-VIIIA illustrated in FIG. 3A is partly or entirely illustrated FIGS. 3B and 4 for indicating a positional relationship between each line and the deformation suppressing portion 40.

Figure 5A:
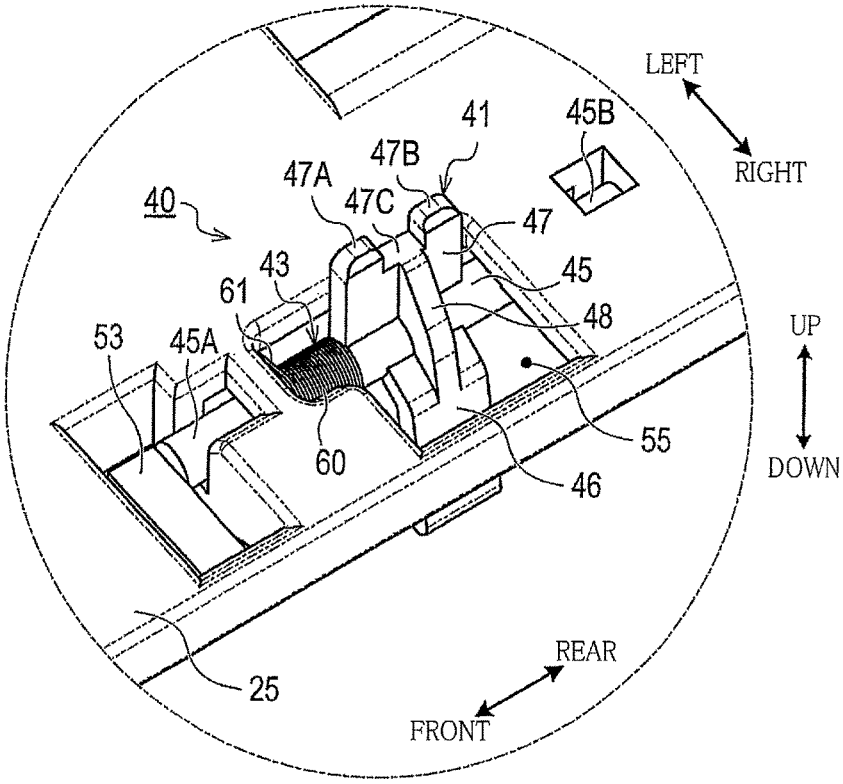
FIG. 5A is a perspective view of a movable member viewed from an obliquely upper side thereof.
Figure 5B:
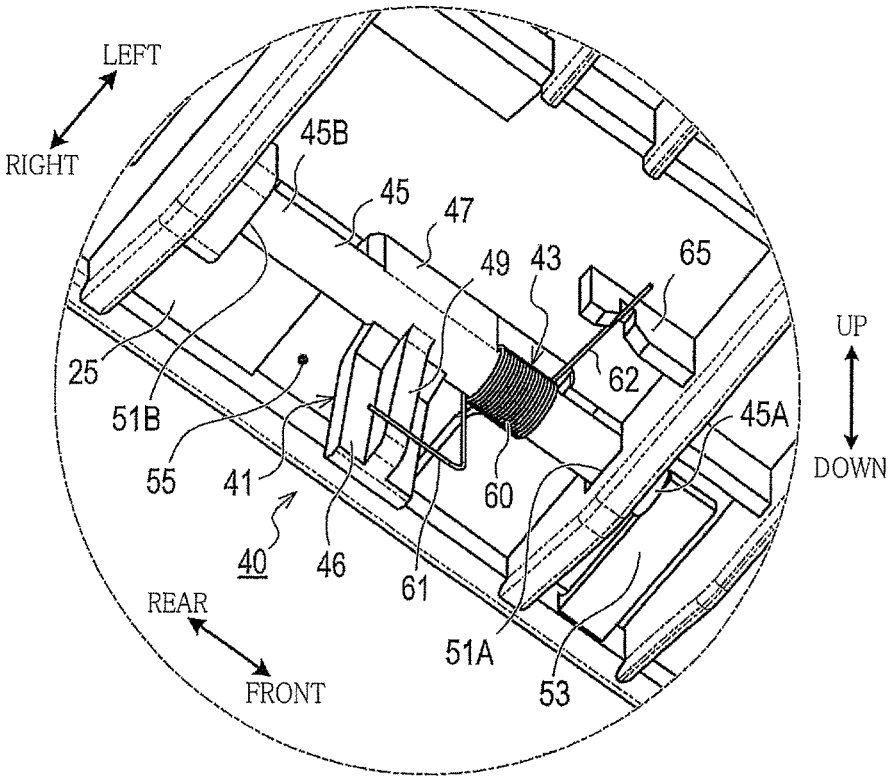
FIG. 5B is a perspective view of the movable member viewed from an obliquely lower side thereof.

As illustrated in FIGS. 4, 5A, and 5B, the deformation suppressing portion 40 includes: a movable member 41 pivotably or turnably mounted on the guide 25; and an urging member 43 for urging the movable member 41 in a predetermined urging direction. The movable member 41 is formed of resin and includes a support shaft 45, a first protrusion 46, a second protrusion 47, a first rib 48, and a second rib 49 which are formed integrally. As illustrated in FIG. 4, the line VIIIA-VIIIA extends so as to coincide with a center of the second protrusion 47 in the right and left direction only at an area including the second protrusion 47 and extends so as to coincide with a center of the support shaft 45 in the right and left direction at the other area.

The axis of the support shaft 45 extends in the front and rear direction in FIGS. 4, 5A, and 5B. Opposite ends 45A, 45B of the support shaft 45 in its axial direction are pivotably supported respectively by bearing portions 51A, 51B formed integrally with the guide 25. As illustrated in FIG. 5B, an elastic piece 53 is formed integrally with the guide 25, and this elastic piece 53 extends leftward in FIG. 5B. This elastic piece 53 is held in contact with one end 45A of the support shaft 45 at a rear edge of the elastic piece 53 in FIG. 5B, whereby the elastic piece 53 functions as a retainer, and the support shaft 45 is held so as not to come out of the bearing portions 51A, 51B.

When mounting the support shaft 45 on the bearing portions 51A, 51B, the one end 45A of the support shaft 45 is first inserted into the bearing portion 51A. In this insertion, the one end 45A of the support shaft 45 is inserted obliquely upward toward an area over the elastic piece 53 so as not to contact with the elastic piece 53. In this state, when the other end 45B of the support shaft 45 is moved toward the bearing portion 51B (upward in FIGS. 5A and 5B), the one end 45A of the support shaft 45 is moved while elastically deforming the elastic piece 53, so that the entire support shaft 45 and the bearing portions 51A, 51B are positioned on the same axis. In this state, in the case where the support shaft 45 is slid toward the bearing portion 51B (rearward in FIGS. 5A and 5B), when the one end 45A of the support shaft 45 reaches a position located at a rear of the elastic piece 53 in FIG. 5B, the shape of the elastic piece 53 is returned from the elastically deformed shape, whereby the elastic piece 53 functions as the retainer.

The first protrusion 46 protrudes from the support shaft 45 obliquely to the lower right thereof in FIGS. 4, 5A, and 5B. The second protrusion 47 protrudes from the support shaft 45 upward in FIGS. 4, 5A, and 5B. Protruding portions 47A, 47B are respectively provided on front and rear side portions of an upper end of the second protrusion 47. A recessed portion 47C is formed between the protruding portion 47A and the protruding portion 47B. The first rib 48 is provided so as to protrude from the first protrusion 46 and the second protrusion 47 in a direction perpendicular to plate portions of the first protrusion 46 and the second protrusion 47. This construction enhances flexural rigidity of the first protrusion 46 and the second protrusion 47. The second rib 49 is provided so as to protrude from the first protrusion 46 in a direction perpendicular to the plate portion of the first protrusion 46. This construction enhances the flexural rigidity of the first protrusion 46.

The guide 25 has a through hole 55 formed therethrough in the up and down direction in FIGS. 5A and 5B. The second protrusion 47 and the first rib 48 extend through the through hole 55. The through hole 55 has a shape in which the second protrusion 47 enters the through hole 55 when the movable member 41 is pivoted. Also, the shape of the through hole 55 is determined such that the guide 25 and the second protrusion 47 do not interfere with each other even when the support shaft 45 is slid frontward in FIG. 4 in the operation of mounting the support shaft 45 on the bearing portions 51A, 51B.

The urging member 43 is constituted by a metal torsion coil spring and includes a coil portion 60 and a pair of arm portions 61, 62 respectively extending from opposite ends of the coil portion 60. The support shaft 45 of the movable member 41 extends on an inner circumferential side of the coil portion 60. The one arm portion 61 is held in contact with the first protrusion 46 of the movable member 41, and the other arm portion 62 is held in contact with an arm receiver 65 formed integrally with the guide 25. In this contact state, the arm portions 61, 62 are held in a state in which the arm portions 61, 62 are moved in their respective directions in which the arm portions 61, 62 tighten the coil portion 60 in its circumferential direction. Thus, the arm portion 61 urges the first protrusion 46 rightward in FIGS. 4, 5A, and 5B.

Figure 6:
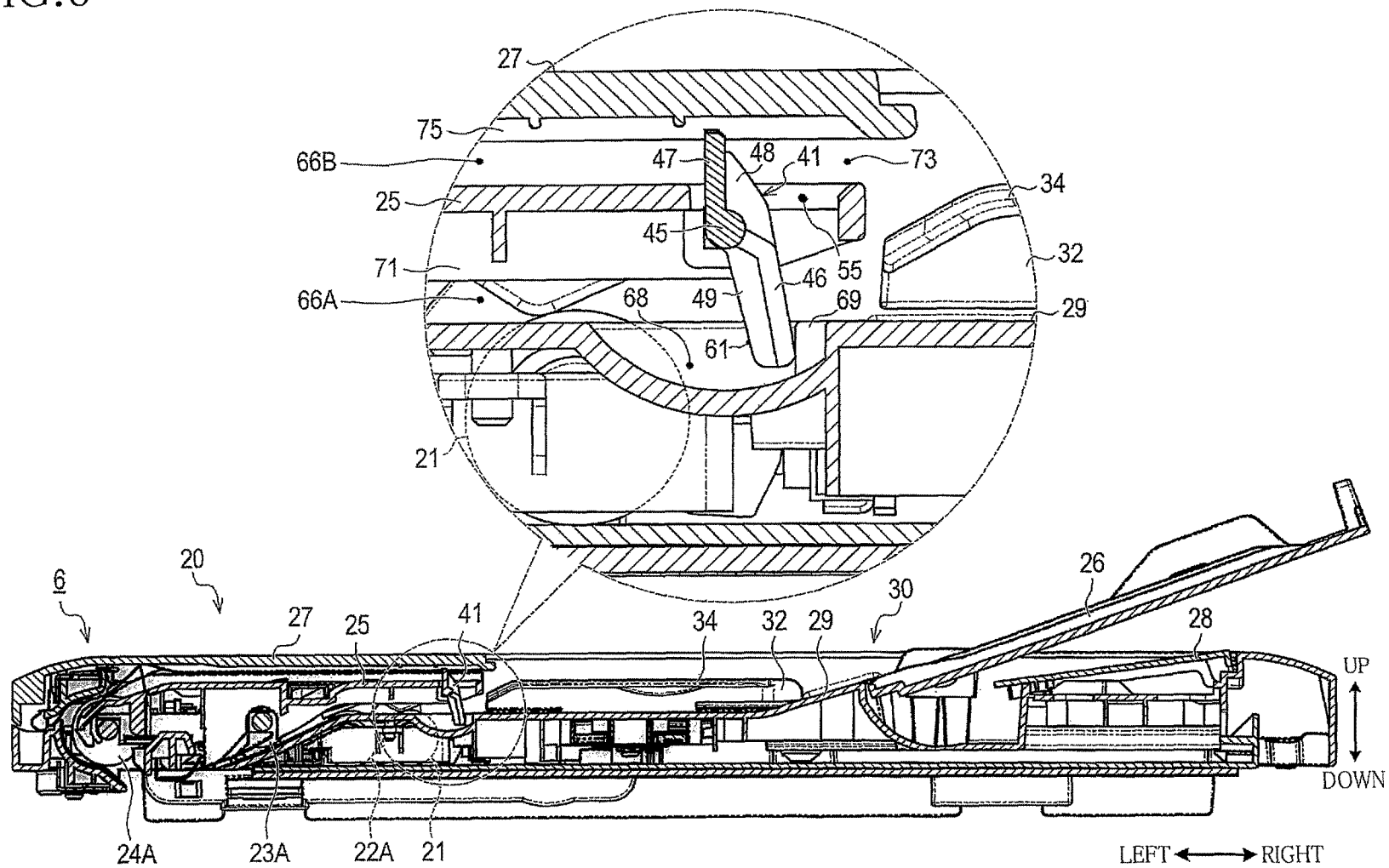
FIG. 6 is a cross-sectional view of the ADF unit taken along line VI-VI in FIG. 3A.

As illustrated in FIG. 6, a first path 66A corresponding to a portion of the conveyance path is formed on one of opposite sides of the guide 25 (i.e., one of upper and lower sides of the guide 25 in FIG. 6) which is farther from the left cover 27. On the other of the opposite sides which is nearer to the left cover 27, a second path 66B is formed which corresponds to a portion of the conveyance path which is located downstream of the first path 66A in the conveying direction. In other words, the first path 66A is formed adjacent to a lower surface (as one example of a first surface) of the guide 25, and the second path 66B is formed adjacent to an upper surface (as one example of a second surface) of the guide 25.

In the state illustrated in FIG. 6, the first protrusion 46 protrudes into the first path 66A formed under the guide 25, and the second protrusion 47 protrudes into the second path 66B formed over the guide 25. The main tray 29 has a recessed portion 68 in which a stopper 69 stands upright as illustrated in FIGS. 4 and 6.

When viewed from a side illustrated in FIG. 6, that is, when viewed from a front side, the movable member 41 is urged by the urging member 43 (noted that FIG. 6 illustrates only the arm portion 61) in the counterclockwise direction in FIG. 6. Thus, in the case where the sheet to be supplied to the conveying unit 20 is not set on the supporter 30, the movable member 41 is pivoted in the counterclockwise direction when viewed from the side illustrated in FIG. 6 (i.e., the front side), so that the distal end of the first protrusion 46 is moved into the recessed portion 68 and brought into contact with the stopper 69. As a result, the pivotal movement of the movable member 41 is stopped by the stopper 69, so that the movable member 41 is at rest at a position at which the movable member 41 is held in contact with the stopper 69 (noted that this position is one example of a first position and hereinafter referred to as "first position").

While the movable member 41 is stopped at the first position by the contact of the first protrusion 46 with the stopper 69 in the present embodiment, a component equivalent to the stopper may be provided at a position at which the component contacts the second protrusion 47 when the movable member 41 is moved to the first position. That is, when the movable member 41 is pivoted or turned to the first position, the component equivalent to the stopper may contact any portion of the movable member 41.

On the other hand, when the sheet to be supplied to the conveying unit 20 is set on the supporter 30, the movable member 41 contacts the sheet to be supplied into the first path 66A. The movable member 41 is pivoted, by a force applied from the sheet by this contact, in the clockwise direction when viewed from the side illustrated in FIG. 6 (i.e., the front side), so that the movable member 41 is moved to a position such as a position illustrated in FIG. 7A or a position illustrated in FIG. 7B. That is, the movable member 41 is pivoted from the first position to the second position against the urging force of the urging member 43. In this operation, the distal end of the second protrusion 47 (as one example of a free end of the movable member) is pivoted so as to move away from the left cover 27. Also after all the sheets on the supporter 30 are supplied to the conveying unit 20, when the sheet is discharged from the conveying unit 20, the movable member 41 contacts the sheet conveyed in the second path 66B. The movable member 41 is pivoted, by a force applied from the sheet by this contact, in the clockwise direction when viewed from the side illustrated in FIG. 6 (i.e., the front side). In this operation, the movable member 41 is pivoted against the urging force of the urging member 43 to move the arm portion 61 in the direction in which the coil portion 60 is tightened. Since the movable member 41 is pivoted in this manner, the urging member 43 is constituted by a torsion coil spring which has such a spring constant that allows the movable member 41 to be pivoted by a force applied from the sheet.

Figure 7A:
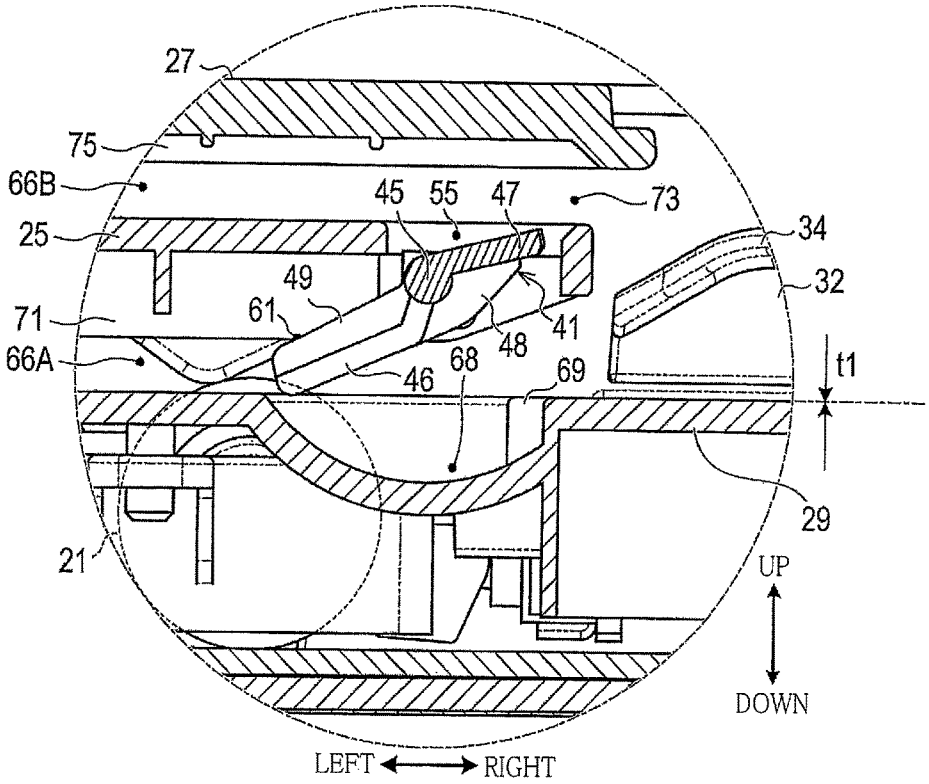
FIG. 7A is a view for explaining a position of the movable member when one sheet is set.
Figure 7B:
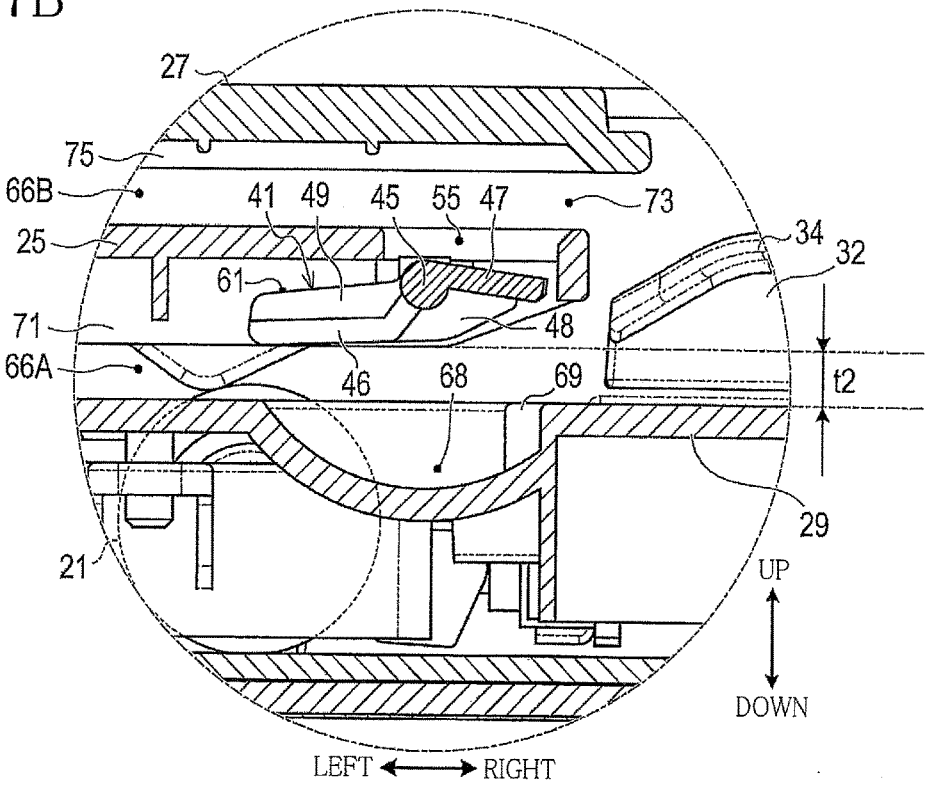
FIG. 7B is a view for explaining a position of the movable member when the maximum number of sheets are set.

A rotation angle by which the movable member 41 is pivoted when the sheets are set on the supporter 30 depends upon the entire thickness of the sheets set on the supporter 30. FIG. 7A illustrates a position of the movable member 41 in the case where the entire thickness of the sheets is a minimum value t1. FIG. 7B illustrates a position of the movable member 41 in the case where the entire thickness of the sheets is a maximum value t2 (noted that this position is one example of a second position and hereinafter referred to as "second position"). That is, when the sheets are set on the supporter 30, the movable member 41 is pivoted from the first position toward the second position, but the entire thickness of the sheets determines whether the movable member 41 reaches the second position or not by the pivotal movement. A rib 71 protruding toward the main tray 29 is formed on the guide 25 at an area opposite the main tray 29 (i.e., a portion of the guide 25 which faces downward in FIGS. 7A and 7B). The maximum value t2 corresponds to a distance between a lower end of the rib 71 and an upper surface of the main tray 29. When the sheet supported on the supporter 30 is removed, or when the sheet conveyed in the second path 66B has passed through the second path 66B, the movable member 41 is pivoted from the second position toward the first position by the urging force of the urging member 43. In this movement, the distal end of the second protrusion 47 is pivoted about the support shaft 45 toward the left cover 27. Thereafter, the first protrusion 46 is brought into contact with the stopper 69 to keep the movable member 41 at the first position, and the distal end of the second protrusion 47 is positioned so as to be opposed to a lower surface of the left cover 27. When the left cover 27 is deformed downward in the state in which the movable member 41 is located at the first position, the lower surface of the left cover 27 is brought into contact with the distal end of the second protrusion 47, so that the left cover 27 is supported by the guide 25 via the movable member 41. When the movable member 41 is located at the second position as illustrated in FIGS. 7A and 7B, the distal end of the second protrusion 47 is located below a surface of the guide 25 which faces the left cover 27, and accordingly the distal end of the second protrusion 47 does not contact the lower surface of the left cover 27 due to the downward deformation of the left cover 27.

Figure 8A:
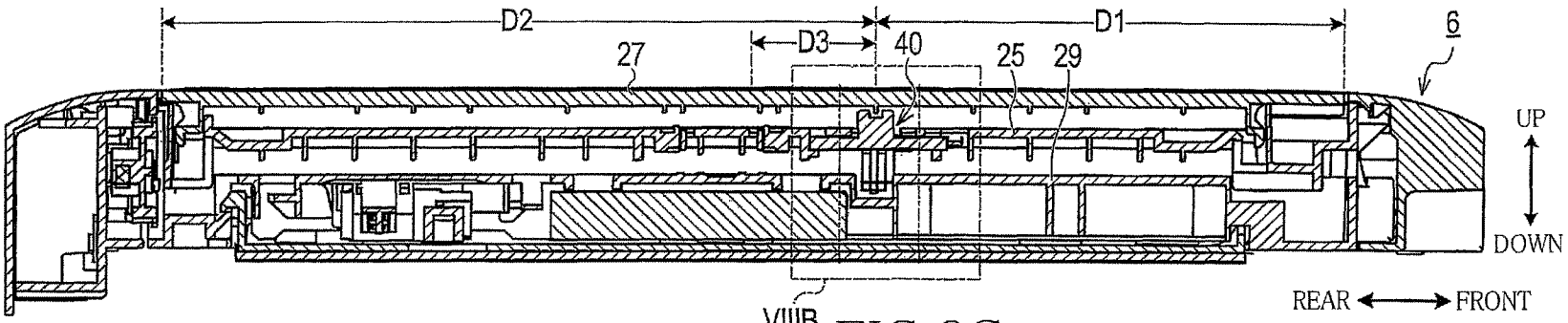
FIG. 8A is a cross-sectional view of the ADF unit taken along line VIIIA-VIIIA in FIG. 3A.

In the right and left direction in FIG. 6, the movable member 41 is provided near an opening 73 which is formed between the left cover 27 and the guide 25 and serves as an outlet or exit of the second path 66B. As illustrated in FIG. 8A, in the widthwise direction (the front and rear direction in FIG. 8A) perpendicular to the sheet conveying direction, the movable member 41 is disposed such that a distance D3 between the movable member 41 and the center of the left cover 27 in the widthwise direction is shorter than each of distances D1, D2 between the movable member 41 and respective opposite ends of the left cover 27 in the widthwise direction.

Figure 8B:
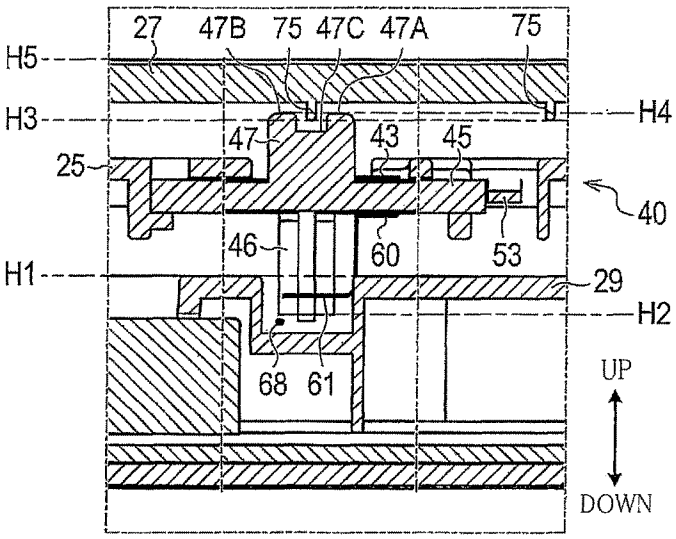
FIG. 8B is an enlarged view of an area VIIIB in FIG. 8A.

As illustrated in FIG. 8B, in the state in which the movable member 41 is located at the first position, the distal end of the first protrusion 46 (i.e., the lower end in FIG. 8B) is located at a height position H2 that is below a height position H1 of the upper surface of the main tray 29. The sheet conveyed along the first path 66A is conveyed above the height position H1 of the upper surface of the main tray 29. This construction allows the sheet to be reliably brought into contact with the first protrusion 46 when the sheet is conveyed along the first path 66A.

A plurality of ribs 75 protruding toward the guide 25 are formed on a portion of the left cover 27 which faces the guide 25 (downward in FIG. 8B). Lower ends of the respective ribs 75 prevent the sheet conveyed along the second path 66B from moving to a position above the lower ends. Thus, an area below a height position H3 illustrated in FIG. 8B is used as the second path 66B. The distal end of the second protrusion 47 (i.e., the distal ends of the respective protruding portions 47A, 47B) is located at a height position H4 located above the height position H3. One of the ribs 75 is located in the recessed portion 47C formed between the protruding portions 47A, 47B. This construction allows the sheet to be reliably brought into contact with the second protrusion 47 when the sheet is conveyed along the second path 66B.

Figure 8C:
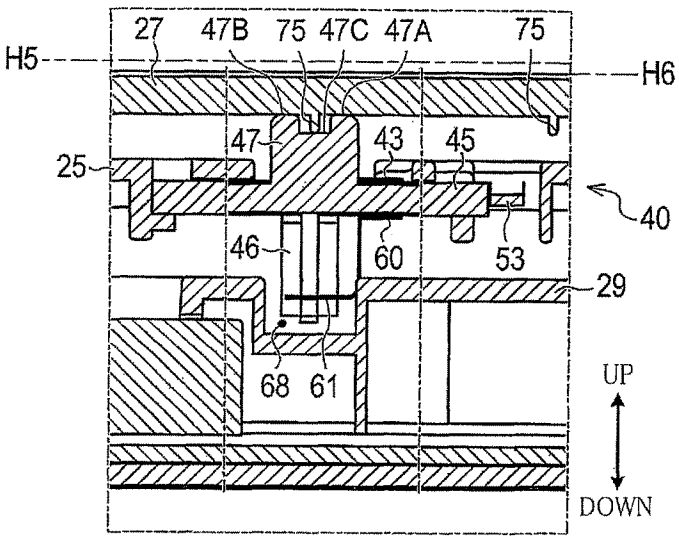
FIG. 8C is a view for explaining a state in which a left cover is distorted and displaced downward at an area illustrated in FIG. 8B.

In the deformation suppressing portion 40 described above, when the left cover 27 is moved to a position nearer to the guide 25 than a predetermined position in the state in which the movable member 41 is located at the first position, as illustrated in FIG. 8C, the movable member 41 contacts the left cover 27 to prevent the left cover 27 from further moving toward the guide 25. More specifically, in the case where a heavy object is placed on the left cover 27, for example, the left cover 27 may be deformed by a load of the heavy object. If a construction equivalent to the deformation suppressing portion 40 is not provided in this case, the left cover 27 is distorted or strained, so that a central portion of the sheet in the widthwise direction (i.e., the front and rear direction in FIG. 8A) lowers most easily among the sheet.

On the other hand, in the construction in which the deformation suppressing portion 40 is provided for the central portion of the sheet in the widthwise direction (i.e., the front and rear direction in FIG. 8A), even if the left cover 27 is moved toward the guide 25, the movable member 41 contacts the left cover 27. In the example in FIGS. 8B and 8C, the left cover 27 is moved from a height position H5 to a height position H6, the movable member 41 contacts the lower surface of the left cover 27 at the distal end of the second protrusion 47 (i.e., the distal ends of the respective protruding portions 47A, 47B which are one example of the free end of the movable member). This contact allows the movable member 41 to support the lower surface of the left cover 27, preventing the left cover 27 from being further deformed to a position located below the height position H6, preventing distortion of the left cover 27.

Figure 9:
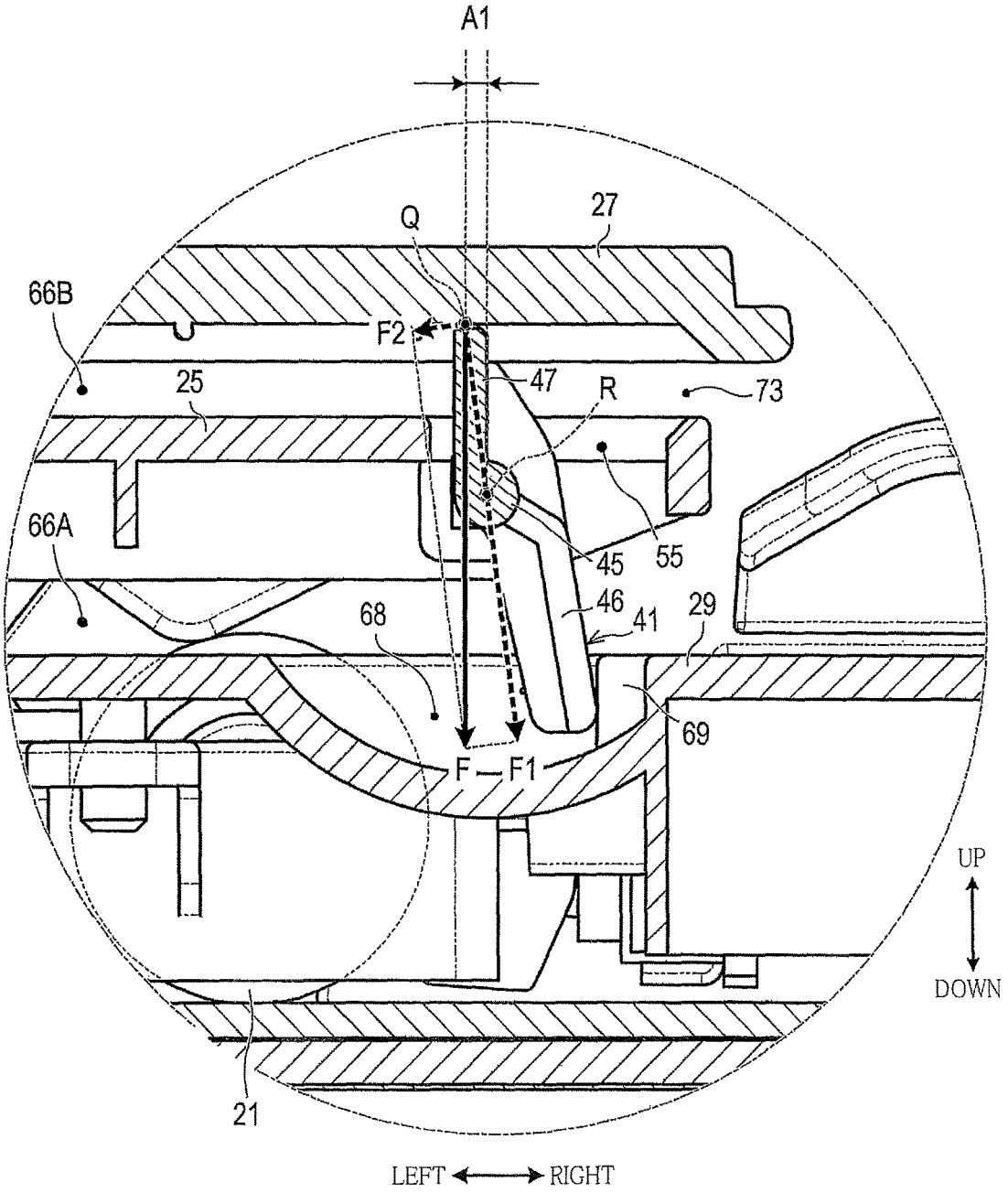
FIG. 9 is a view for explaining a direction of a force applied from the left cover to the movable member.

In the present embodiment, as illustrated in FIG. 9, it is assumed that the movable member 41 contacts the left cover 27 at a contact area Q, and a force F is applied from the left cover 27 to the contact area when the movable member 41 contacts the left cover 27. The contact area Q and a pivot center R of the movable member 41 have a relative positional relationship in which in the case where the force F is divided into (i) a first component force F1 acting in a direction of a straight line connecting between the pivot center R and the contact area Q and (ii) a second component force F2 acting in a direction perpendicular to the direction of the first component force F1, the second component force F2 acts in a direction in which the movable member 41 is pivoted toward the first position. That is, the contact area Q is located on the left of the pivot center R by a distance A1 in the right and left direction in FIG. 9, whereby the second component force F2 acts in the direction in which the movable member 41 is pivoted in the counterclockwise direction in FIG. 9 (i.e., toward the first position). Accordingly, when the force F is applied to the left cover 27, it becomes difficult for the movable member 41 to be pivoted in the clockwise direction in FIG. 9, suppressing the pivotal movement of the movable member 41 toward the second position.

In the state in which the force F is acting on the left cover 27 in this manner, the pivotal movement of the movable member 41 toward the second position is limited, whereby the first protrusion 46 inhibits the sheet from being introduced into the first path 66A. In this state, the first protrusion 46 of the movable member 41 contacts the sheet to be supplied to the first path 66A at a position located upstream of the supply roller 21 of the conveying unit 20 in the conveying direction. Thus, even in the case where a sheet is placed on the supporter 30 by the user, the sheet cannot be appropriately set at a position at which the sheet is held in contact with the supply roller 21, until the movable member 41 is pivoted toward the second position. Accordingly, in a situation in which a sheet is easily jammed in the second path 66B due to downward displacement of the left cover 27, the movable member 41 is inhibited from conveying the sheet, preventing occurrence of a sheet jam.

Effects

In the MFP 1 described above, in the case where the movable member 41 is located at the first position, when a load is applied to the left cover 27, the movable member 41 prevents the load from deforming the left cover 27 in a direction toward the guide 25. This construction may suppress the deformation of the left cover 27 without excessively increasing the stiffness of the left cover 27. Thus, the left cover 27 may be easily made thinner, thereby making the entire ADF unit 6 thinner accordingly. In the case where the sheet is conveyed by the conveying unit 20, the movable member 41 is moved from the first position toward the second position to a position at which the movable member 41 does not inhibit the conveyance of the sheet by the conveying unit 20. Accordingly, when conveying the sheet, the conveying unit 20 may convey the sheet appropriately, without the movable member 41 interfering with the conveyance.

In the above-described MFP 1, the movable member 41 is moved from the first position toward the second position by a force received from the sheet. This construction eliminates a need for providing a specific power source or the like to actuate the movable member 41, resulting in a simple construction for actuating the movable member 41. Also, the movable member 41 is provided at a position at which the sheet contacts the movable member 41 when the sheet is set on the supporter 30. With this construction, the movable member 41 may be moved to the second position only by setting the sheet on the supporter 30.

In the above-described MFP 1, the movable member 41 is located nearer to the center of the left cover 27 in the widthwise direction than to each of the opposite ends of the left cover 27 in the widthwise direction and located near the opening 73 serving as the exit of the second path 66B. In other words, the movable member 41 supports the left cover 27 at an area near a portion of the left cover 27 which may be deformed in the greatest degree among the cover 27. This construction may effectively suppress the deformation of the left cover 27.

In the above-described MFP 1, the movable member 41 is urged by the urging member 43 so as to be moved toward the first position. Accordingly, different from a construction in which the urging member 43 is not provided, the movable member 41 may be reliably kept urged toward the first position without affected by, e.g., an inclination of the MFP 1.

In the above-described MFP 1, when the sheet is brought into contact with the first protrusion 46 or the second protrusion 47, the movable member 41 is moved from the first position toward the second position. With this construction, different from a construction in which the sheet contacts the movable member 41 only at its portion equivalent to the second protrusion 47, the movable member 41 may be moved toward the second position when the sheet is brought into contact with the first protrusion 46. Accordingly, the sheet may be conveyed more smoothly in the second path 66B.

In the above-described MFP 1, when the second protrusion 47 of the movable member 41 has contacted the left cover 27, the first protrusion 46 inhibits the sheet from entering the first path 66A. Accordingly, when the left cover 27 is moved to a position nearer to the guide 25 than the predetermined position, it is possible to prevent occurrence of a sheet jam in the second path 66B.

ALTERNATIVE EMBODIMENTS

While the embodiment has been described above, it is to be understood that the disclosure is not limited to the details of the illustrated embodiment, but may be embodied with various changes and modifications, which may occur to those skilled in the art, without departing from the spirit and scope of the disclosure. It is noted that the same reference numerals as used in the above-described embodiment are used to designate the corresponding elements in the following explanation.

Figure 10A:
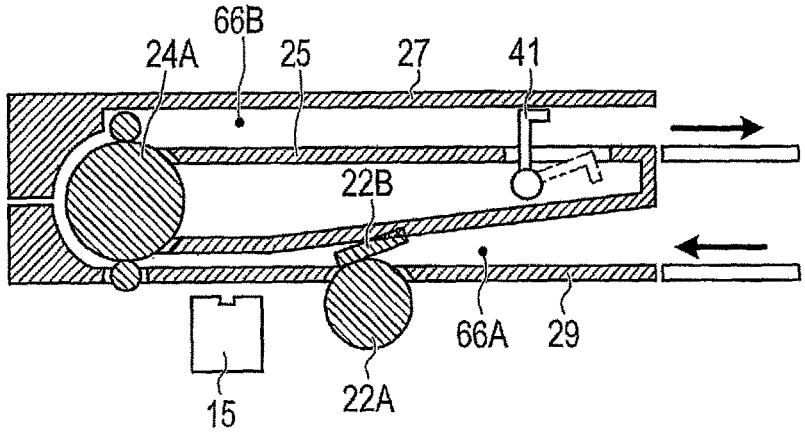
FIG. 10A is a view for explaining an embodiment in which the movable member is provided on an exit side of a conveyance path and is not provided on an entrance side.

While the movable member 41 includes the first protrusion 46 and the second protrusion 47 in the above-described embodiment, the movable member 41 can support the left cover 27 from below as long as the movable member 41 includes the second protrusion 47. Accordingly, the first protrusion 46 is not essential. For example, as illustrated in FIG. 10A, the movable member 41 may have a portion equivalent to the second protrusion 47 without having a portion equivalent to the first protrusion 46.

Figure 10B:
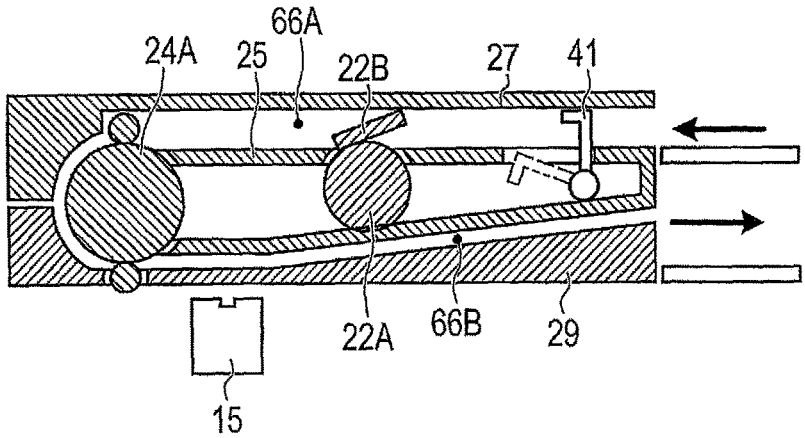
FIG. 10B is a view for explaining an embodiment in which a conveying direction is reverse to that in the above embodiment.

In the above-described embodiment, the conveyance path in which the sheet is conveyed by the conveying unit 20 has the U-turn shape in which the sheet is conveyed from the lower first path 66A to the upper second path 66B while making U-turn. However, this sheet conveying direction may be a direction reverse to the sheet conveying direction in the above-described embodiment. Specifically, for example, as illustrated in FIG. 10B, the conveyance path may have a shape in which the sheet is conveyed from an upper first path 66A to a lower second path 66B while making U-turn. In this construction, a direction of the pivotal movement of the movable member 41 may be changed appropriately according to the sheet conveying direction. Also, corresponding positional changes may be made as needed for other components such as the separation roller 22A and the separation piece 22B illustrated in FIG. 10B.

Figure 10C:
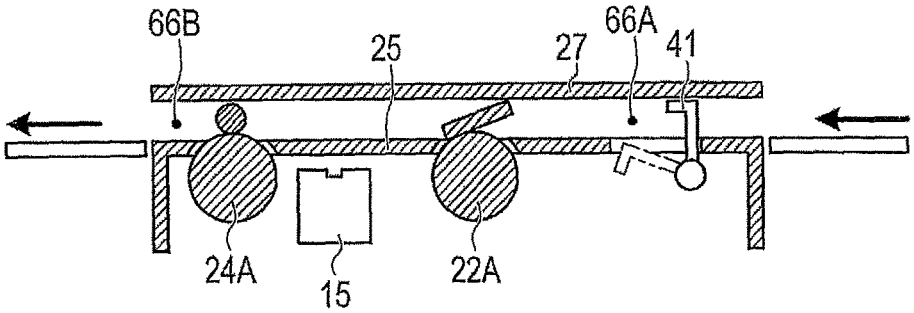
FIG. 10C is a view for explaining an embodiment in which the conveyance path extends generally straight.

While the conveyance path has the U-turn shape in the above-described embodiment, but this construction is not essential. For example, as illustrated in FIG. 10C, the conveyance path may extend generally straight (that is, the conveyance path may be what is called a straight path). Also with this construction, the movable member 41 can support a component equivalent to the left cover 27 to suppress deformation of the component equivalent to the left cover 27.

While the pivot center of the movable member 41 is located nearer to the guide 25, and the distal end of the movable member 41 near the guide 25 contacts the left cover 27 in the above-described embodiment, the MFP 1 may be configured such that the pivot center of the movable member is located nearer to the cover, and the distal end of the movable member near the cover contacts the guide.

It is noted that the ADF unit 6 of the MFP 1 is employed as one example of the sheet conveying device in the above-described embodiment, but the sheet conveying device may not be provided in the MFP. For example, the above-described construction may be employed for an image reading device having only an image reading function, a copying machine, and a facsimile machine.

While the ADF of the image reading apparatus as the MFP 1 has the construction of the sheet conveying device in the above-described embodiment, an image forming apparatus may have the construction of the sheet conveying device. For example, the sheet conveying device may be constructed as a portion of the image forming apparatus by replacing the image sensor 15 with the recording head in FIGS. 10A-10C.

What is claimed is:

1. A sheet conveying device, comprising:

a conveyor configured to convey a sheet along a conveyance path in a conveying direction;

a guide;

a cover spaced apart from the guide and configured to cover the guide, the conveyance path formed between the guide and cover, the cover having a length that is greater than that of the guide in a direction perpendicular to the conveying direction and parallel with the guide; and a movable member mounted on a first member which is one of the cover and the guide, the movable member being pivotable between a first position and a second position, the movable member located at the second position when the conveyor is conveying the sheet along the conveyance path, the movable member comprising a free end configured to be moved toward a second member while the movable member is being pivoted from the second position to the first position about a pivot center, the second member being another of the cover and the guide, the free end of the movable member configured to be contactable with the second member when the movable member is located at the first position, wherein the movable member is pivotably supported by the first member, and wherein the guide is configured to support the cover via the movable member in a state in which the free end is in contact with the second member, wherein the movable member is located at the first position in a state in which the sheet is not in contact with the movable member, and wherein the movable member is pivoted from the first position toward the second position by contact of the sheet with the movable member.

2. The sheet conveying device according to claim 1, wherein the free end of the movable member does not contact the second member by the approach of the cover toward the guide when the movable member is located at the second position.

3. The sheet conveying device according to claim 1, wherein the free end of the movable member is configured to be moved away from the second member when the movable member is pivoted from the first position toward the second position.

4. The sheet conveying device according to claim 1, further comprising a supporter configured to support the sheet which has not been conveyed by the conveyor yet, wherein the movable member is disposed at a position at which the movable member is in contact with the sheet supported by the supporter.

5. The sheet conveying device according to claim 1, wherein in a widthwise direction of the sheet which is perpendicular to the conveying direction, the movable member is disposed closer to a center of the cover in the widthwise direction than to an end of the cover in the widthwise direction.

6. The sheet conveying device according to claim 1, wherein the movable member is disposed in a vicinity of an opening formed between the cover and the guide, and the opening serves as one of an entrance to the conveyance path and an exit from the conveyance path.

7. The sheet conveying device according to claim 1, further comprising an urging member configured to urge the movable member in a direction in which the movable member is pivoted from the second position toward the first position.

8. The sheet conveying device according to claim 7, further comprising a stopper configured to hold the movable member at the first position against an urging force of the urging member.

9. The sheet conveying device according to claim 1, wherein the cover is configured to cover an entirety of the guide.

10. The sheet conveying device according to claim 1, wherein the free end of the movable member is spaced apart from the second member when the movable member is located at the first position, and wherein when the second member spaced apart from the free end of the movable member is moved downward by an external force, the second member is brought into contact with the free end of the movable member located at the first position.

11. A sheet conveying device, comprising:

a conveyor configured to convey a sheet along a conveyance path in a conveying direction;

a cover configured to cover the conveyor;

a guide spaced apart from the cover, the conveyance path formed therebetween; and a movable member mounted on a first member which is one of the cover and the guide, the movable member being pivotable between a first position and a second position, the movable member located at the second position when the conveyor is conveying the sheet along the conveyance path, the movable member comprising a free end configured to be moved toward a second member while the movable member is being pivoted from the second position to the first position about a pivot center, the second member being another of the cover and the guide, the free end of the movable member configured to contact with the second member by an approach of the cover toward the guide when the movable member is located at the first position, wherein the movable member is pivotably supported by the first member, wherein the guide is configured to support the cover via the movable member in a state in which the free end is in contact with the second member, wherein the guide comprises a first surface and a second surface opposite to each other, and the first surface is farther from the cover than the second surface, wherein the conveyance path comprises: a first path nearer to the first surface than to the second surface; and a second path nearer to the second surface than to the first surface and located downstream of the first path in the conveying direction, wherein the movable member is rotatably mounted on the guide as the first member and comprises: a first protrusion protruding from the pivot center toward the first path when the movable member is located at the first position; and a second protrusion protruding from the pivot center toward the second path when the movable member is located at the first position, wherein the movable member is configured such that when the movable member is located at the first position, the cover contacts the second protrusion by the approach of the cover toward the guide, and wherein the movable member is configured such that when the sheet is conveyed by the conveyor, the sheet is brought into contact with one of the first protrusion and the second protrusion to pivot the movable member from the first position toward the second position.

12. The sheet conveying device according to claim 11, further comprising a supporter configured to support the sheet which has not been conveyed by the conveyor yet, wherein the sheet supported by the supporter contacts the first protrusion.

13. The sheet conveying device according to claim 11, wherein the sheet conveyed along the second path contacts the second protrusion.

14. The sheet conveying device according to claim 13, wherein the conveyor comprises a supply roller configured to convey the sheet which has not been conveyed by the conveyor yet, into the conveyance path, and wherein the movable member is configured such that the first protrusion contacts the sheet to be conveyed into the first path, at a position located upstream of the supply roller in the conveying direction.

15. The sheet conveying device according to claim 11, wherein in a state in which the movable member is located at the first position, and the cover is in contact with the second protrusion by the approach of the cover toward the guide, pivotal movement of the movable member is limited, and the first protrusion limits conveyance of the sheet into the first path.

16. A sheet conveying device, comprising:

a conveyor configured to convey a sheet along a conveyance path in a conveying direction;

a guide; a cover spaced apart from the guide and configured to cover the guide, the conveyance path formed between the guide and cover, the cover having a length that is greater than that of the guide in a direction perpendicular to the conveying direction and parallel with the guide; and a movable member mounted on a first member which is one of the cover and the guide, the movable member being pivotable between a first position and a second position, the movable member located at the second position when the conveyor is conveying the sheet along the conveyance path, the movable member comprising a free end configured to be moved toward a second member while the movable member is being pivoted from the second position to the first position about a pivot center, the second member being another of the cover and the guide, the free end of the movable member configured to contact with the second member by an approach of the cover toward the guide when the movable member is located at the first position, wherein the movable member is pivotably mounted on the first member, wherein the free end of the movable member is configured to contact the second member at a contact area, and a force is applied from the second member to the contact area when the free end and the second member are in contact with each other, wherein the contact area and the pivot center of the movable member comprise a relative positional relationship in which when the force is divided into (i) a first component force acting in a direction of a straight line connecting between the pivot center and the contact area and (ii) a second component force acting in a direction perpendicular to the direction of the first component force, the second component force acts so as to pivot the movable member in a direction directed from the second position toward the first position.

17. A sheet conveying device, comprising:

a conveyor configured to convey a sheet along a conveyance path in a conveying direction;

a cover configured to cover the conveyor;

a guide spaced apart from the cover, the conveyance path formed therebetween: and a movable member mounted on a first member which is one of the cover and the guide, the movable member being pivotable between a first position and a second position, the movable member located at the second position when the conveyor is conveying the sheet along the conveyance path, the movable member comprising a free end configured to be moved toward a second member while the movable member is being pivoted from the second position to the first position about a pivot center, the second member being another of the cover and the guide, the free end of the movable member configured to contact with the second member by an approach of the cover toward the guide when the movable member is located at the first position, wherein the movable member is pivotably supported by the first member, wherein the guide is configured to support the cover via the movable member in a state in which the free end is in contact with the second member, wherein the conveyance path comprises a first path and a second path located downstream of the first path in the conveying direction, the first path and the second path being opposing to each other with interposing the guide therebetween, wherein the movable member is rotatably mounted on the guide as the first member and comprises: a first protrusion protruding from the pivot center toward the first path when the movable member is located at the first position; and a second protrusion protruding from the pivot center toward the second path when the movable member is located at the first position, wherein the movable member is pivoted from the first position toward the second position by contact of the sheet with the first protrusion or the second protrusion, wherein the movable member is configured such that when the movable member is located at the first position, the cover as the second member contacts one of the first protrusion and the second protrusion by the approach of the cover toward the guide, wherein the stopper comprises a contact surface which contacts another of the first protrusion and the second protrusion, and wherein, while the contact surface is in contact with said another of the first protrusion and the second protrusion, the stopper restricts the movement of a first free end of the first protrusion in the first path in the first direction and restricts the movement of a second free end of the second protrusion in the second path in the first direction.

* * * * *